US010483063B1

(12) United States Patent
Ahn

(10) Patent No.: US 10,483,063 B1
(45) Date of Patent: Nov. 19, 2019

(54) PROTECTIVE RELAY WITH EASY WITHDRAWAL

(71) Applicant: LSIS CO., LTD., Anyang-si, Gyeonggi-do (KR)

(72) Inventor: Hong-Seon Ahn, Anyang-si (KR)

(73) Assignee: LSIS CO., LTD., Anyang-si, Gyeonggi-Do (KR)

( * ) Notice: Subject to any disclaimer, the term of this patent is extended or adjusted under 35 U.S.C. 154(b) by 0 days.

(21) Appl. No.: 16/224,079

(22) Filed: Dec. 18, 2018

(30) Foreign Application Priority Data

Jun. 12, 2018 (KR) ..... 10-2018-0067387

(51) Int. Cl.
*H01H 45/02* (2006.01)

(52) U.S. Cl.
CPC ..... *H01H 45/02* (2013.01); *H01H 2223/04* (2013.01)

(58) Field of Classification Search
CPC ..... H01H 45/02; H01H 2223/04
USPC ..... 361/626, 731, 732
See application file for complete search history.

(56) References Cited

U.S. PATENT DOCUMENTS 4,210,951 A * 7/1980 Ritter ..... H05K 5/0208 361/725
5,652,695 A * 7/1997 Schmitt ..... G11B 33/126 361/679.31
5,668,696 A * 9/1997 Schmitt ..... G11B 33/127 361/679.31
5,844,781 A * 12/1998 Schlotterer ..... H05K 5/062 361/752
6,356,441 B1 * 3/2002 Claprood ..... G06F 1/184 312/332.1
6,429,547 B1 * 8/2002 Muroi ..... G04G 15/00 307/132 R
6,490,153 B1 * 12/2002 Casebolt ..... G06F 1/184 361/679.33
6,840,680 B1 * 1/2005 Chiu ..... G02B 6/3825 385/53
6,851,867 B2 * 2/2005 Pang ..... G02B 6/3825 385/134
6,916,190 B2 * 7/2005 Joist ..... H05K 7/1409 361/732
7,191,076 B2 * 3/2007 Huber ..... G01D 4/004 700/291
8,498,120 B2 * 7/2013 Chen ..... H05K 5/0221 312/223.1

FOREIGN PATENT DOCUMENTS

JP 2015015792 A * 1/2015
KR 20100102008 A 9/2010
KR 101752085 B1 6/2017

* cited by examiner

*Primary Examiner* — Anatoly Vortman
(74) *Attorney, Agent, or Firm* — K&L Gates LLP

(57) ABSTRACT

The present disclosure relates to a protective relay. According to the present disclosure, the handle is fixed or separated by a lever structure rather than a gear structure, so that the user may easily fix or separate the handle to or from the outer casing. Therefore, convenience and operability of the user are improved.

3 Claims, 10 Drawing Sheets

100:110,130,150

【FIG. 1】
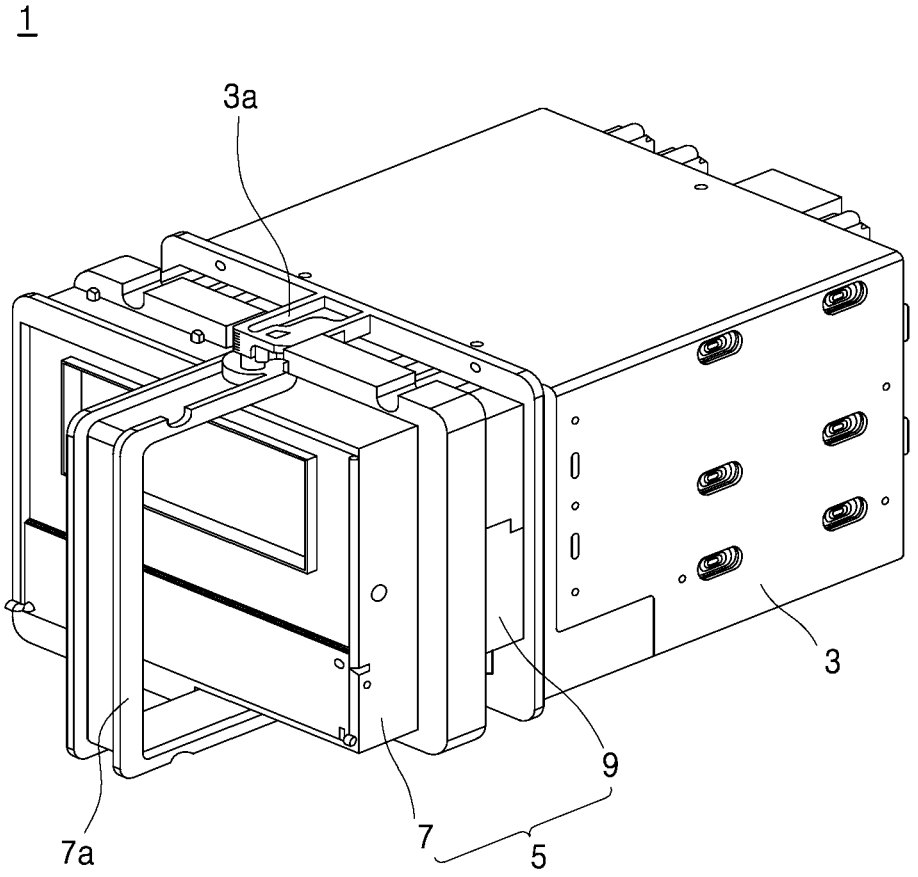
[PRIOR ART]

【FIG. 2】
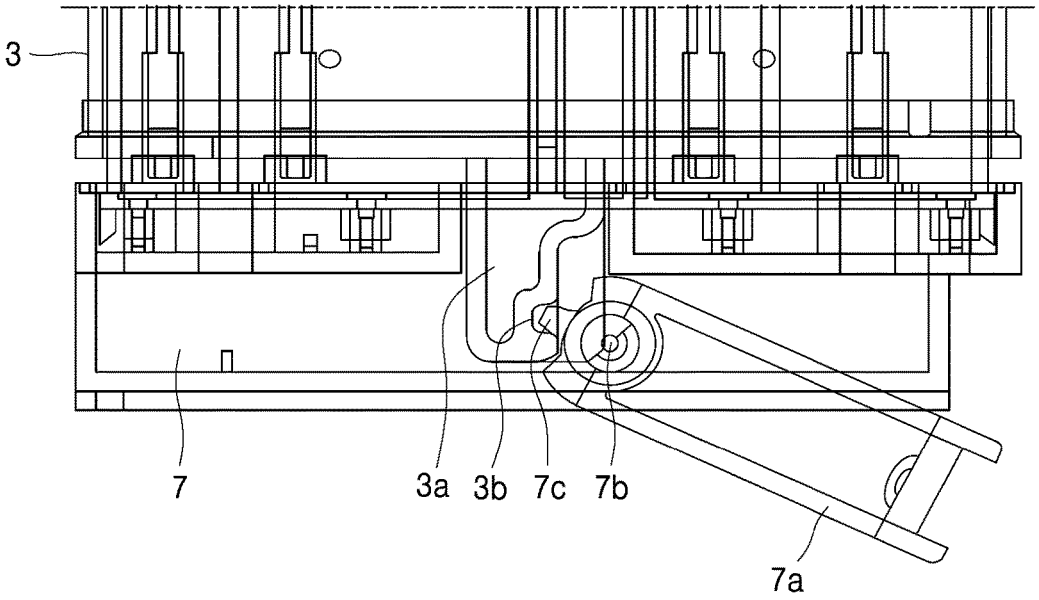
[PRIOR ART]

【FIG. 3】
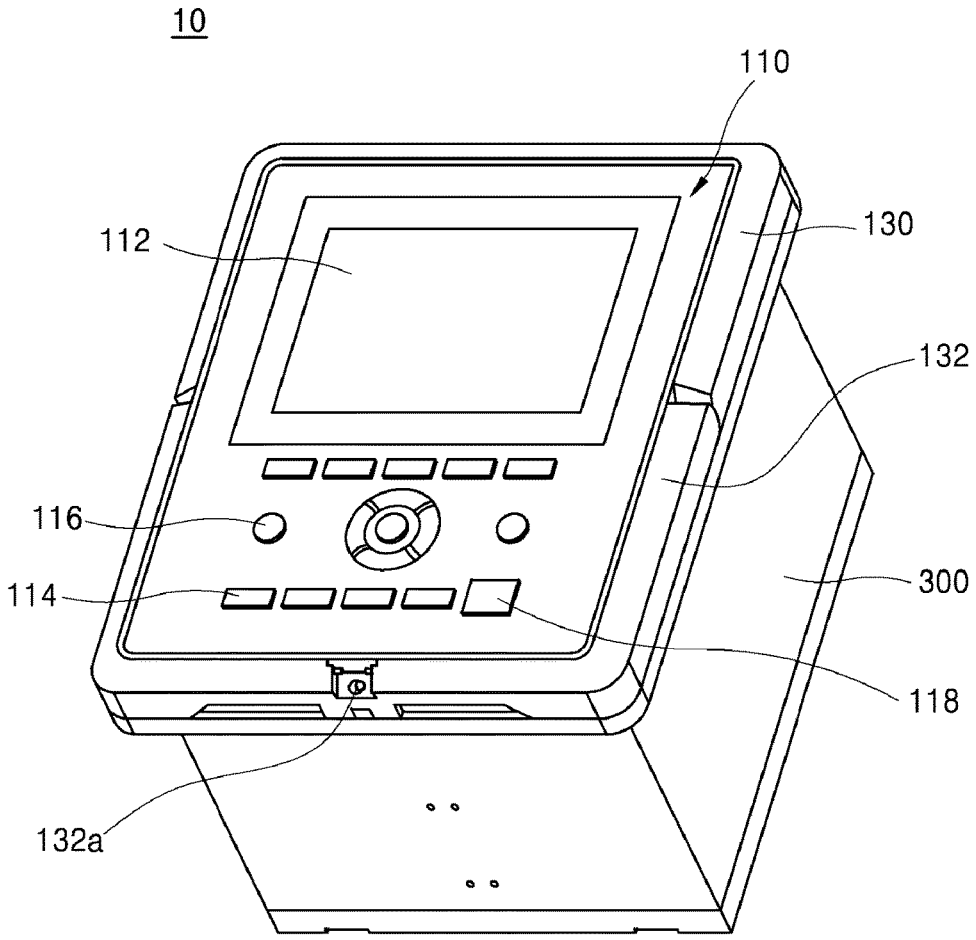

【FIG. 4】
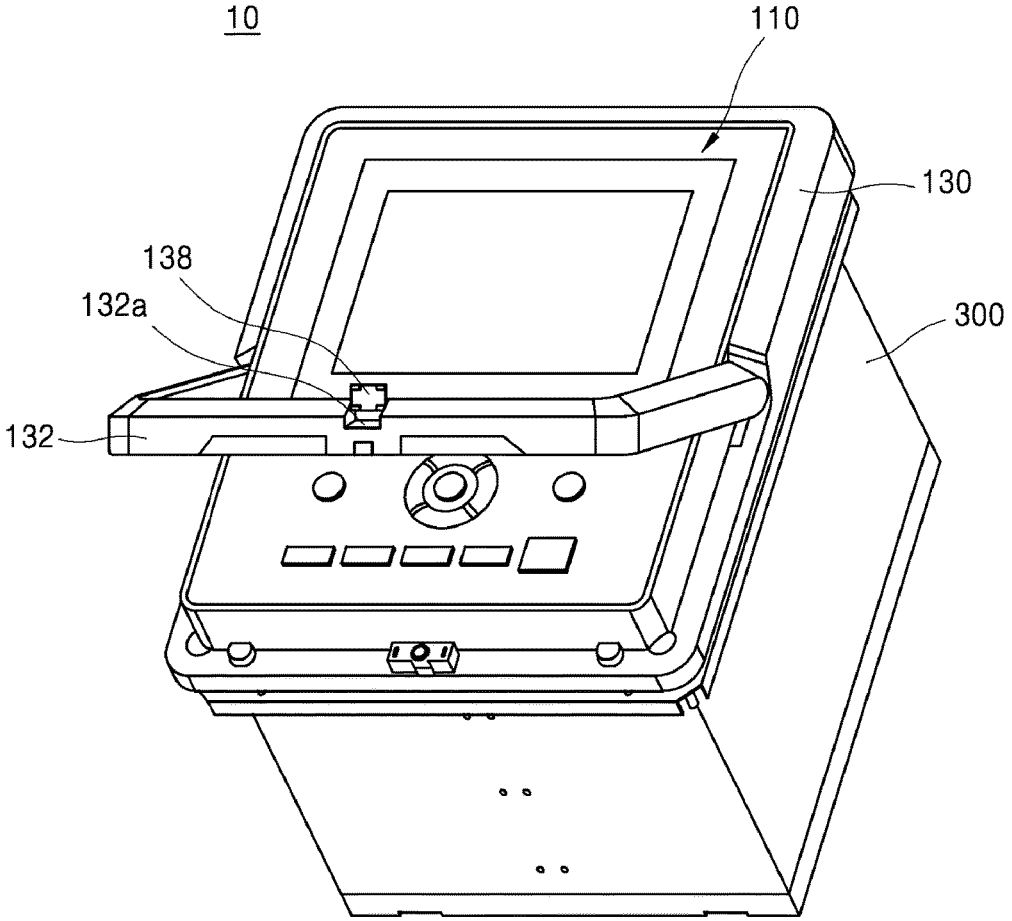

【FIG. 5】
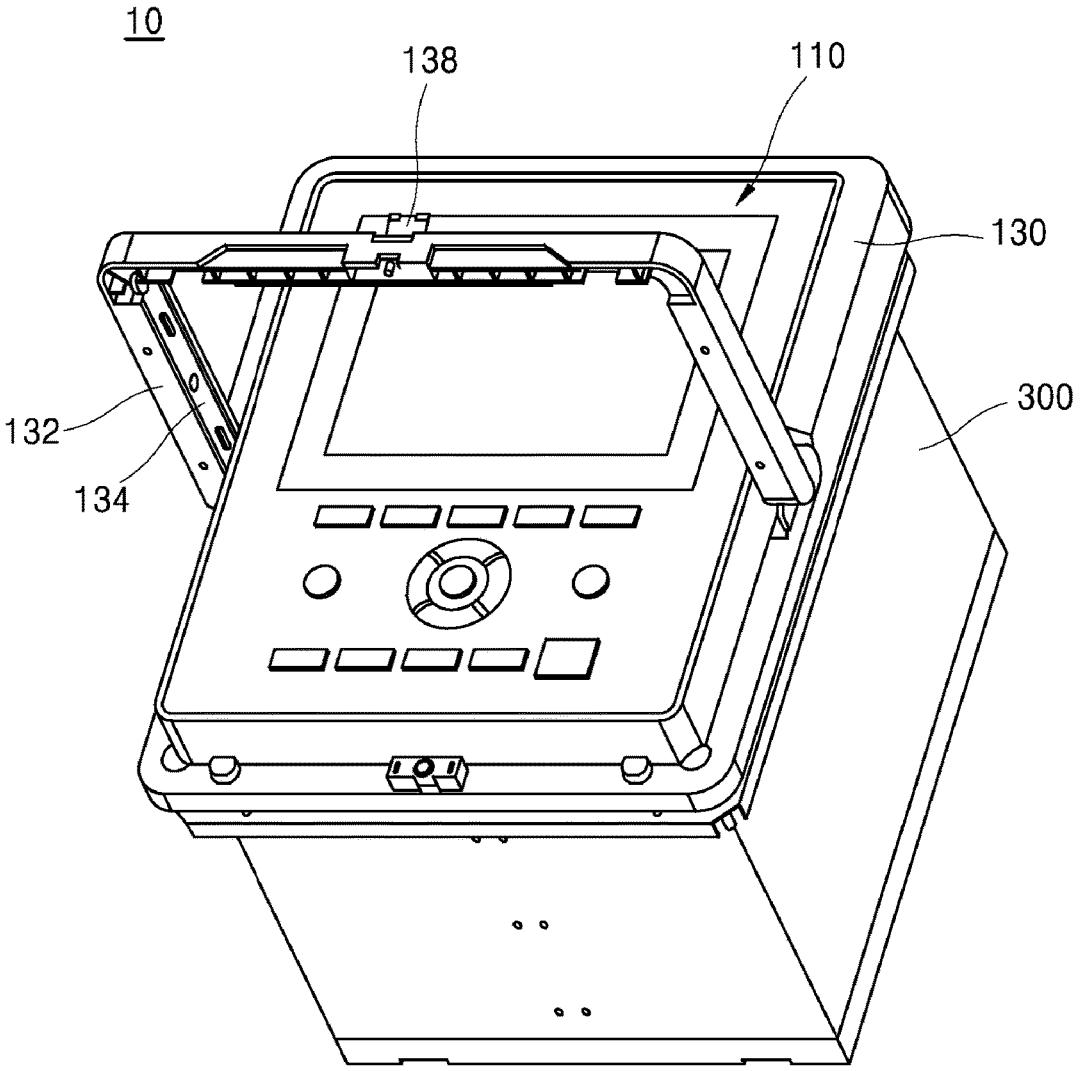

【FIG. 6】
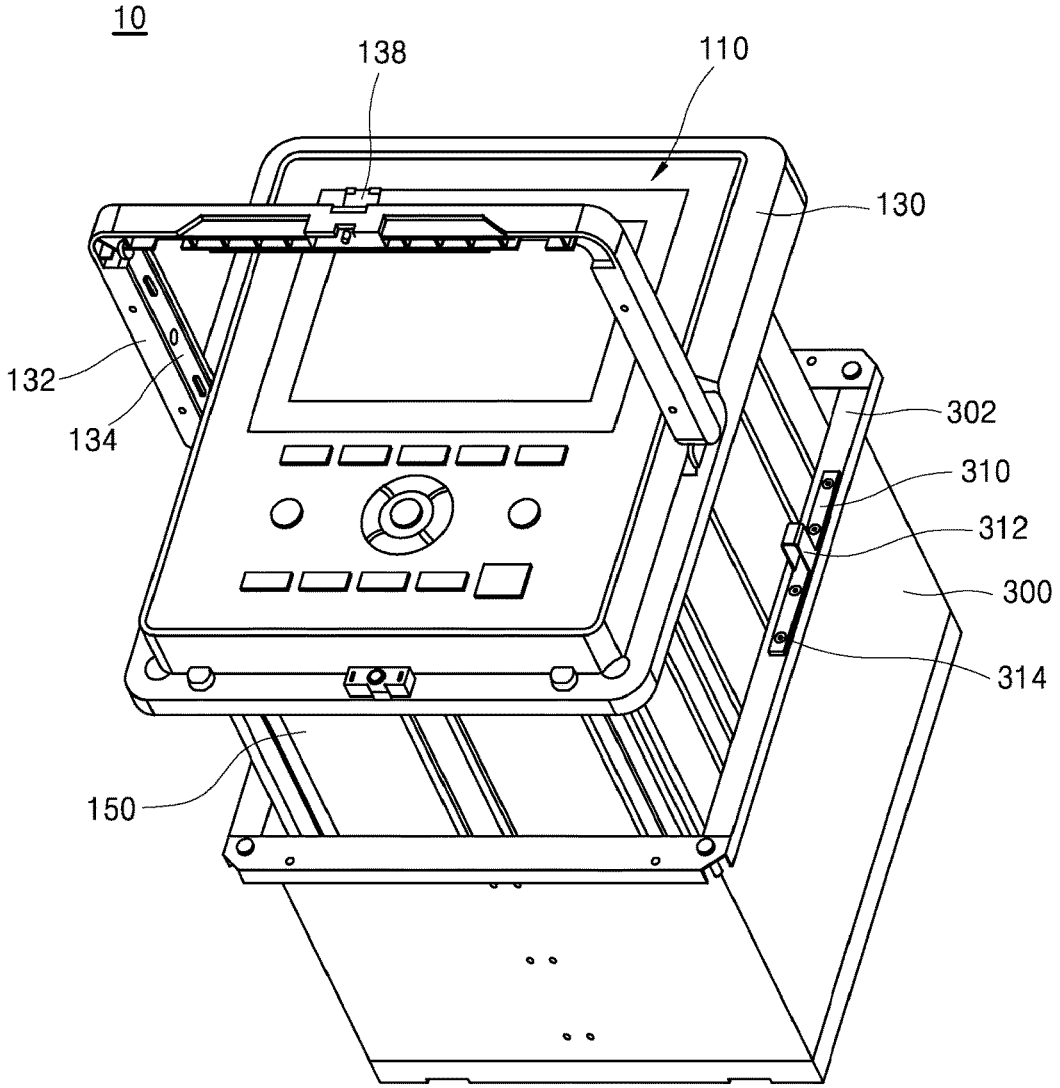
100:110,130,150

【FIG. 7】
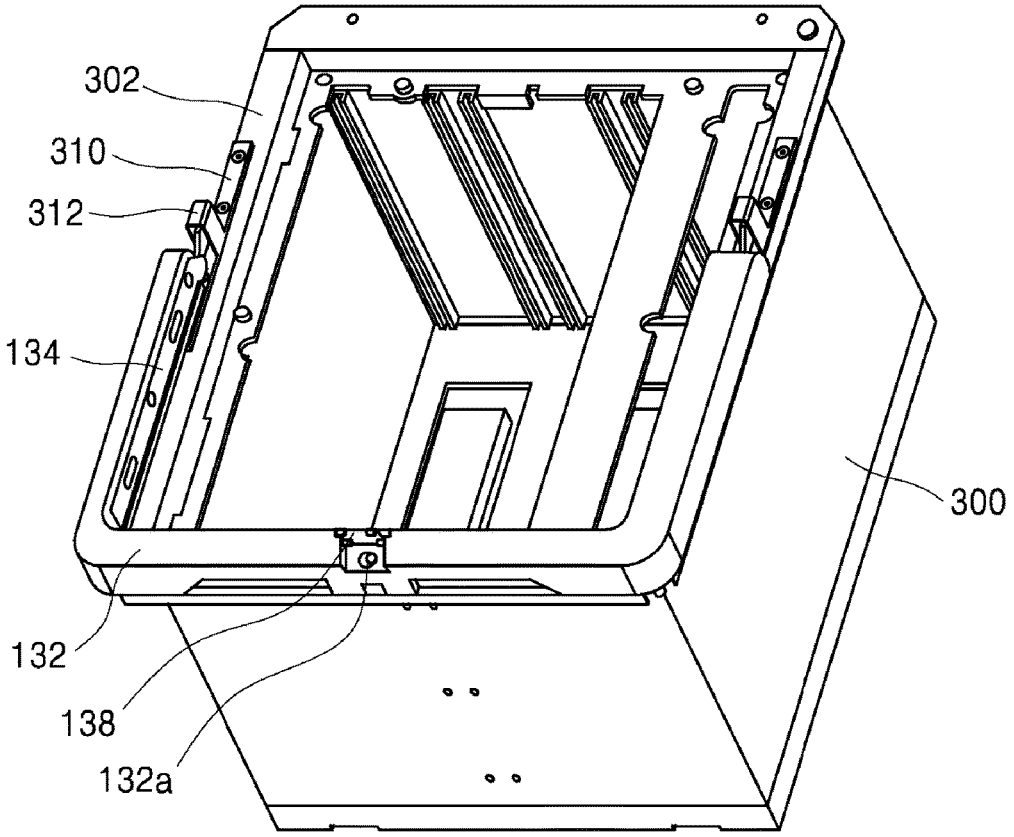

【FIG. 8】
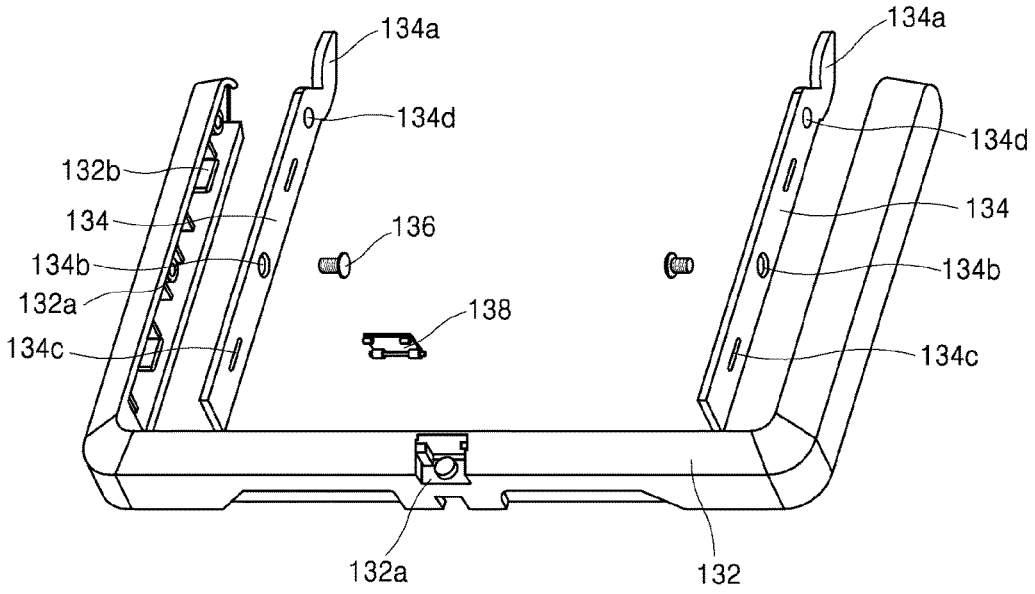

【FIG. 9】
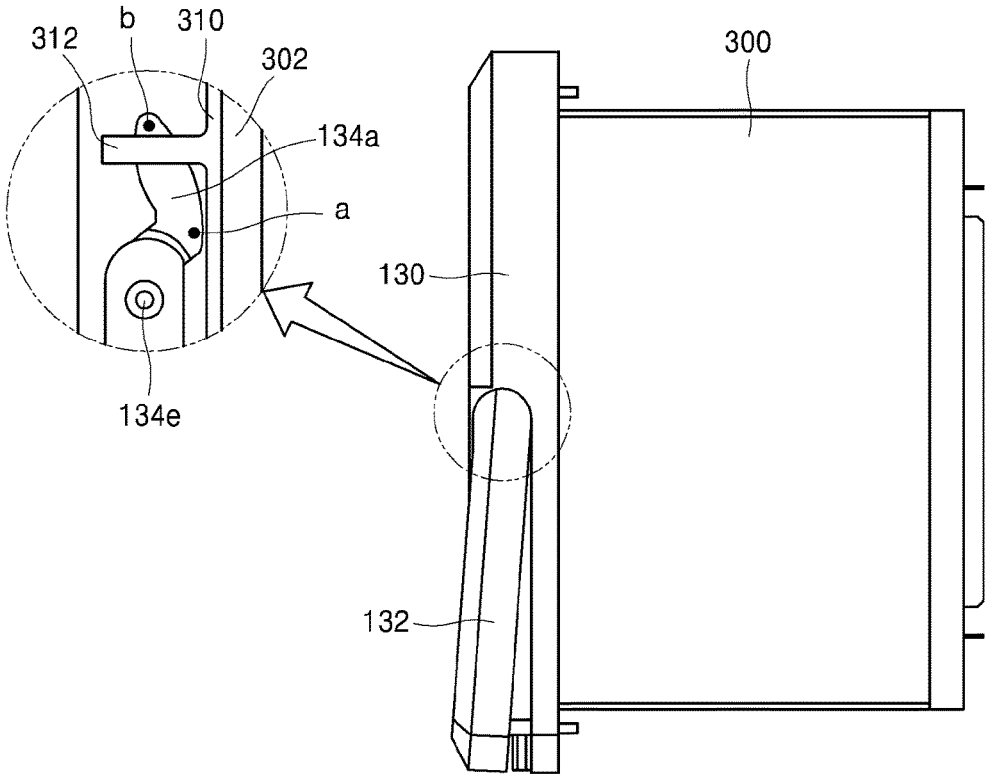

【FIG. 10】
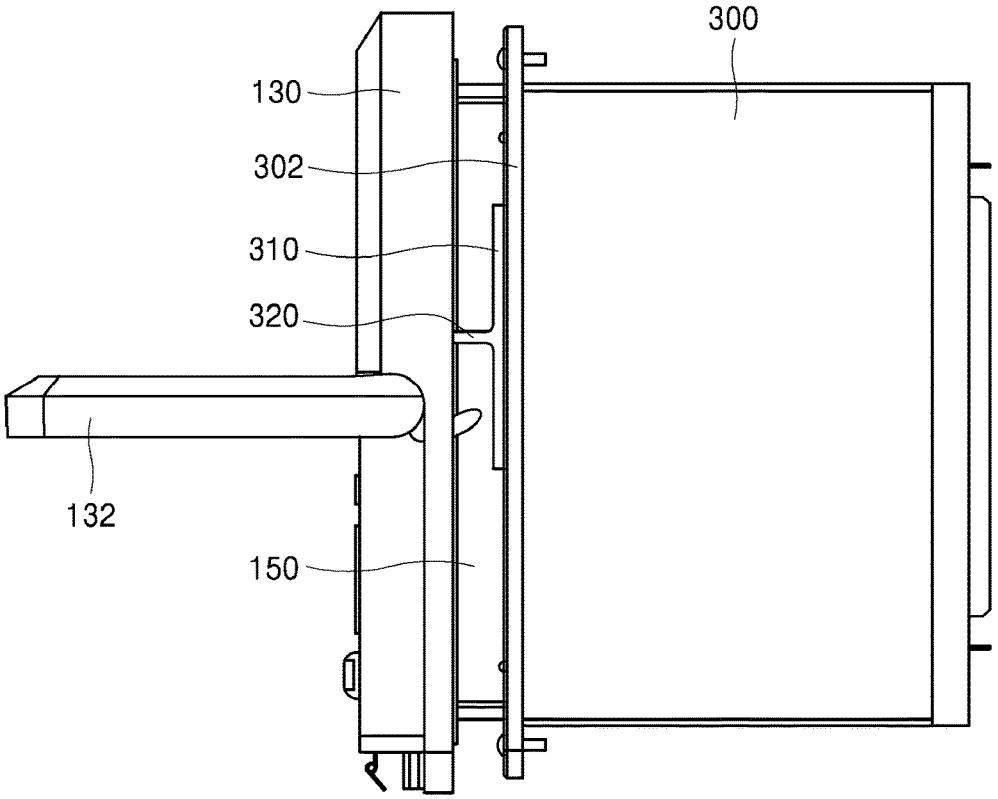

PROTECTIVE RELAY WITH EASY WITHDRAWAL

CROSS-REFERENCE TO RELATED APPLICATIONS

Pursuant to 35 U.S.C. § 119(a), this application claims the benefit of earlier filing date and right of priority to Korean Application No. 10-2018-0067387 filed on Jun. 12, 2018, in the Korean Intellectual Property Office, the disclosure of which is hereby incorporated by reference in its entirety.

BACKGROUND

1. Technical Field

The present disclosure relates to a protective relay that is easy to be pulled out with a handle structure that allows the protective relay to be pulled out easily by applying a pull-out force to the protective relay.

2. Description of the Related Art

A protective relay is a device that immediately detects and cuts off a failure part when an overload, an overcurrent, or the like causes an abnormality or failure in a wire or device.

In general, the protective relay consists of an inner casing and an outer casing. The inner casing consists of a front casing and a back casing. The inner casing of the protective relay is detachably mounted in the outer casing. This is a structure that facilitates an installation or removal of a connection signal line with other devices when mounting or pulling out the protective relay to/from an electrical switchboard.

The inner casing has a predetermined weight because various components are accommodated therein. Therefore, when a user inserts or pulls out the inner casing into/from the outer casing, the inner casing must be lifted. For a convenience of the user, a handle is provided at the front casing of the inner casing.

Hereinafter, a handle assembly structure according to a conventional protective relay will be described with reference to drawings.

FIG. 1 is a perspective view illustrating a state in which a conventional protective relay is mounted or pulled out. FIG. 2 is a plane view illustrating a coupling structure of a handle according to a protective relay of FIG. 1.

As shown in FIG. 1, in the conventional protective relay, an inner casing 5 is coupled to an outer casing 3 such that the inner casing 5 may be inserted and pulled out to/from the outer casing 3. The inner casing 5 consists of a front casing 7 and a back casing 9. In the front casing 7, a handle 7*a* is pivotably coupled. The outer casing 3 is provided with a support structure for pivotably supporting the handle 7*a* at a portion adjacent to the handle 7*a*.

As shown in FIG. 2, the handle 7*a* is pivotably mounted to the front casing 7 by a hinge 7*b*. The handle 7*a* is pivoted in one direction or the other direction around the hinge 7*b*. For example, the one direction may be counterclockwise, and the other direction may be clockwise. The handle 7*a* has a gear pin 7*c* protruded at one end thereof in a longitudinal direction adjacent to the hinge 7*b*. In the outer casing 3, an outer casing fixing pin 3*a* is formed adjacent to the position of the gear pin 7*c* when the inner casing 5 is coupled.

The outer casing fixing pin 3*a* extends from one end of the outer casing 3 to the front casing 7 of the inner casing 5. A pin inserting groove 3*b* is defined in one side of the outer casing fixing pin 3*a*, into which the gear pin 7*c* is inserted or separated.

When the inner casing 5 is inserted into the outer casing 3, a user may pivot the handle 7*a* in the one direction with respect to FIG. 2. Therefore, as the inner casing 5 is gradually inserted into the outer casing 3, the gear pin 7*c* at the end of the handle 7*a* is to be adjacent to the pin inserting groove 3*b* of the outer casing fixing pin 3*a*. The user may align the position of the gear pin 7*c* of the handle 7*a* with the position of the pin inserting groove 3*b*, and then insert the gear pin 7*c* into the pin inserting groove 3*b*.

When the inner casing 5 is separated from the outer casing, a process proceeds reverse to that described above. When the user lifts the inner casing 5 while pivoting the handle 7*a* in the other direction (clockwise with respect to FIG. 2), the gear pin 7*c* is separated from the pin inserting groove 3*b*. The inner casing 5 is thus separated from the outer casing 3.

However, the handle structure described above is a structure in which, as the user pivots the handle when separating the inner casing from the outer casing, the gear pin is susceptible to be interfered and worn out when exiting from the inserting groove. Thus, the gear pin of the handle is worn out when it was used for a certain period of time, and the handle must be replaced.

In addition, the handle structure described above must maintain an engagement geometry within a titration tolerance in a manufacture of the handle and the outer casing fixing pins to ensure that the gear pin is properly engaged in the inserting groove. Therefore, when an error in the manufacture increases, the handle may not be used, and must be manufactured again, so that the cost is increased.

In order to correctly insert the gear pin into the inserting groove, the user must first check the position of the inserting groove with the eye, even when a properly manufactured handle is mounted. Then, while holding the weight of the inner casing attached to the handle with an arm, the user must insert the gear pin into the inserting groove while pivoting the handle, which is inconvenient for the user.

SUMMARY

A purpose of the present disclosure is to provide a protective relay that is easy to be pulled out and has a handle structure that allows a user to easily pull out or mount an inner casing from or to an outer casing.

In addition, a purpose of the present disclosure is to provide a protective relay that is easy to be pulled out and has an improved handle structure for easy fixing and separation of the handle.

The purposes of the present disclosure are not limited to the above-mentioned purposes. Other purposes and advantages of the present disclosure which are not mentioned may be understood by a following description, and may be more clearly understood by embodiments of the present disclosure. It will also be readily apparent that the purposes and advantages of the present disclosure may be realized by means and combinations thereof set forth in the claims.

The present disclosure relates to a protective relay, the protective relay includes: an inner casing including a back casing having a receiving space defined therein for accommodating a component therein, a front casing having a display and a plurality of buttons, wherein the front casing is coupled to the back casing, and a handle having a lever structure, wherein the handle is pivotably coupled to the front casing; and an outer casing constructed for detachably receiving the inner casing therein, wherein the outer casing includes a support bracket for detachably supporting the handle, wherein when the inner casing is separated from the outer casing, the handle pivots at a state where a portion thereof is in contact with the support bracket, thereby pushing the inner casing out of the outer casing.

The support bracket includes a pair of support brackets respectively mounted on both opposite sides of an open end of the outer casing, wherein each of the support brackets includes a handle support protruding toward the inner casing.

The inner casing further includes a front frame disposed along an edge of the inner casing, and wherein the handle defines a portion of the front frame, and has a '90 degrees-pivoted U' shape, wherein both ends thereof are pivotably coupled to the front casing.

The inner casing further includes both elongate pivotable frames respectively coupled to inner faces of opposite extensions of the handle, wherein each of the pivotable frames has a distal end having a V shaped portion, wherein the distal end is pivotably coupled to the handle support, wherein the pivotable frame has a pivoting point at the distal end, and wherein when the pivotable frame is pivoted around the pivoting point together with a pivoting of the handle, the distal end of the pivotable frame is inserted or separated into or from the support bracket.

The support bracket has a through-hole defined in the handle support in a longitudinal direction of the support bracket.

As the handle pivots such that the inner casing is separated from the outer casing, the distal end of the pivotable frame pivots around the pivoting point to push the inner casing out of the outer casing.

According to the present disclosure, the handle is fixed or separated by a lever structure rather than a gear structure, so that the user may easily fix or separate the handle to/from the outer casing. Therefore, convenience and operability of the user are improved.

In addition, according to the present disclosure, the inner casing may be separated from the outer casing, or may be inserted into the outer casing by simply pivoting the handle. Therefore, assemblability and user convenience are improved.

BRIEF DESCRIPTION OF THE FIGURES

FIG. 1 is a perspective view illustrating a state in which a conventional protective relay is mounted or pulled out.

FIG. 2 is a plane view illustrating a coupling structure of a handle according to a protective relay of FIG. 1.

FIG. 3 is a perspective view illustrating a state in which an inner casing and an outer casing of a protective relay according to an embodiment of the present disclosure are mounted.

FIG. 4 is a perspective view illustrating a state in which a handle is partially pivoted when an inner casing of a protective relay according to FIG. 3 is removed.

FIG. 5 is a perspective view illustrating a state in which a handle is completely pivoted when an inner casing of a protective relay according to FIG. 3 is removed.

FIG. 6 is a perspective view illustrating a state in which an inner casing of a protective relay according to FIG. 3 is removed.

FIG. 7 is a perspective view illustrating a coupling state of an outer casing and a handle of a protective relay according to FIG. 3.

FIG. 8 is an exploded perspective view illustrating a handle of a protective relay according to FIG. 3.

FIG. 9 is a side view of a protective relay according to FIG. 3.

FIG. 10 is a side view of a protective relay according to FIG. 6.

DETAILED DESCRIPTION

The above objects, features and advantages will become apparent from the detailed description with reference to the accompanying drawings. Embodiments are described in sufficient detail to enable those skilled in the art in the art to easily practice the technical idea of the present disclosure. Detailed descriptions of well-known functions or configurations may be omitted in order not to unnecessarily obscure the gist of the present disclosure. Hereinafter, embodiments of the present disclosure will be described in detail with reference to the accompanying drawings. Throughout the drawings, like reference numerals refer to like elements.

First, a coupling structure of a protective relay according to an embodiment of the present disclosure will be described with reference to the drawings.

FIG. 3 is a perspective view illustrating a state in which an inner casing and an outer casing of a protective relay according to an embodiment of the present disclosure are mounted. FIG. 4 is a perspective view illustrating a state in which a handle is partially pivoted when an inner casing of a protective relay according to FIG. 3 is removed. FIG. 5 is a perspective view illustrating a state in which a handle is completely pivoted when an inner casing of a protective relay according to FIG. 3 is removed. FIG. 6 is a perspective view illustrating a state in which an inner casing of a protective relay according to FIG. 3 is removed.

As shown in FIG. 3 to FIG. 6, a protective relay 10 according to an embodiment of the present disclosure consists of an inner casing 100 for mounting various modules therein, and an outer casing 300 for housing the inner casing 100.

When the inner casing 100 is completely inserted into the outer casing 300, various signal lines (CT/PT/DIO, communication line, etc.) for connection with other devices are electrically connected. Conversely, when the inner casing 100 is separated from the outer casing 300, the various signal lines are electrically isolated. A handle and a handle mounting structure is provided for easy pulling out of the weighted inner casing 100 from the outer casing 300, or for easy mounting into the outer casing 300.

The inner casing 100 includes a front casing 110 and a back casing 150.

The front casing 110 constitutes a front of the inner casing 100 (top face with reference to FIG. 1). The front casing 110 may include a display 112 for display, buttons 114 for operating various functions, lamps 116 for displaying a signal, various cable connectors 118, and the like. At an edge of the front casing 110, a front frame 130 for coupling with the back casing 150 is provided. The back casing 150 is coupled to a rear (all except the top face with respect to FIG. 1) of the front casing 110.

A front frame 130 is integrally formed with, or separately formed from the front casing 110, and assembled to the front casing 110. A handle 132 is provided at one side of the front frame 130. A hole or cut-out portion for preventing an interference of the handle 132 when the handle 132 is pivoted may be defined at the front frame 130.

As shown in FIG. 4 to FIG. 6, the handle 132 constitutes a part of the front frame 130. The handle 132 may be disposed at one side or the other side with respect to FIG. 4. The handle 132 is pivotably coupled to the front frame 130. In the coupled state of the inner casing 100 and the outer casing 300, the handle 132 is temporarily fixed to the outer casing 300. When the handle 132 is pivoted to separate the inner casing 100 from the outer casing 300, the handle 132 is separated from the outer casing 300, and the inner casing 100 is ready to be pulled out (a detailed description of the handle and handle fixing structure will be described later).

Herein, the term "temporarily fixed" means that the handle 132 is detachably coupled to the outer casing 300 without being permanently attached thereto.

As shown in FIG. 4, the back casing 150 constitutes remaining faces except the front of the inner casing 100. That is, the back casing 150 has a shape in which a front of a hexahedron (top face with respect to FIG. 4) is opened. Various parts are accommodated in the back casing 150. The back casing 150 and the front casing 110 are coupled to each other by a bolt, a screw, or the like.

The front casing 110 and the back casing 150 are coupled to each other, so that various terminals mounted in the front casing may be connected to various connectors mounted in the back casing 150. The front casing 110 and the back casing 150 are coupled to each other to form the inner casing 100. In this state, the inner casing 100 is inserted into the outer casing 300.

As shown in FIG. 5 and FIG. 6, the outer casing 300 has a shape similar to the shape of the back casing 150 of the inner casing 100. That is, the outer casing 300 has a shape in which a front of a hexahedron (top face with respect to FIG. 5) is opened. Since the inner casing 100 is accommodated in the outer casing 300, a receiving space having a size corresponding to the size of the inner casing 100 is defined in the outer casing 300. In the present disclosure, since the back casing 150 of the inner casing 100 is completely inserted into the outer casing 300, the outer casing 300 has an inner space corresponding to the size of the back casing 150. A frame support 302 for supporting the front frame 130 is formed at an opened edge of the outer casing 300.

When the inner casing 100 is inserted into the outer casing 300, the frame support 302 is brought to be in surface contact with the front frame 130. A support bracket 310 is coupled onto the frame support 302.

The support bracket 310 includes a pair of support brackets. The support brackets 310 are respectively coupled to both opposite sides of the frame support 302. The support bracket 310 has a shorter length than that of one side of the frame support 302. The support bracket 310 may be made of a material having a predetermined rigidity so as to support the handle 132. For example, the support bracket 310 may be made of steel, stainless steel, or the like. The support bracket 310 includes a handle support 312 for pivotably supporting the handle 132, and a coupling hole 314 for engagement with the outer casing 300.

The handle support 312 is protruded toward the front casing 110 with the support bracket 310 coupled to the frame support 302. A through-hole for pivotably supporting the handle 132 is defined in the handle support 312. The through-hole is defined along a longitudinal direction of the support bracket 310. The handle 132 is inserted into the through-hole, and is pivotably supported.

A plurality of the coupling holes 314 are defined in the longitudinal direction of the support bracket 310. A bolt (not shown) is inserted into the coupling hole 314 to connect the support bracket 310 to the frame support 302 of the outer casing 300.

Hereinafter, the handle and the coupling structure of the handle of the protective relay according to an embodiment of the present disclosure will be described in detail.

FIG. 7 is a perspective view illustrating a coupling state of an outer casing and a handle of a protective relay according to FIG. 3. FIG. 8 is an exploded perspective view illustrating a handle of a protective relay according to FIG. 3. FIG. 9 is a side view of a protective relay according to FIG. 3. FIG. 10 is a side view of a protective relay according to FIG. 6.

As shown in FIG. 7 to FIG. 10, the handle 132 is pivotably coupled to one side of the front casing 110. The handle 132 constitutes a part of the front casing 110. Thus, the handle 132 may have a thickness that is slightly thinner than the thickness of the front casing 110. A side provided with the handle 132 has the same thickness as the side where the handle 132 is not provided when the handle 132 is engaged.

As shown in FIG. 8, the handle 132 has a '90 degrees-pivoted U' shape along the shape of the front frame 130. Thus, handle 132 has a shape in which two short frames are combined at both sides of a long frame. The handle 132 is used for lifting the inner casing 100, so that the handle 132 may have a size corresponding to half of the front casing 110. Both ends of the handle 132 are pivotably coupled to the front casing 110 by a hinge 134*e* (with reference to FIG. 9), respectively. A handle fixing part 132*a* into which a bolt (not shown) is inserted is provided on the long frame of the handle 132.

The handle 132 may be temporarily fixed on the front frame 130 by inserting the bolt into the handle fixing part 132*a*. The handle fixing part 132*a* may be opened and closed by a handle cover 138. After the inner casing 100 is inserted into the outer casing 300, it is not necessary to use the handle 132 until separating the inner casing 100, so that the handle 132 may be fixed to the front frame 130 by the bolt. When the inner casing 100 is separated from the outer casing 300, the handle 132 is needed. Thus, when the handle 132 is used, the handle 132 may be released by loosening the bolt.

A plurality of coupling ribs 132*b* having a long protruding shape are formed in a protruding manner from an inner side face of each of both short frames of the handle 132 facing away each other. In addition, a groove (not shown) into which the connecting member 136 is inserted may be defined in the inner side of the short frame. On inner peripheral surface of this groove, a screw groove to be screwed with the connecting member 136 is defined. A groove (not shown) into which the hinge 134*e* is inserted may be defined in the inner side of the short frame of the handle 132. In addition, the plurality of coupling ribs 132*b* coupled with a pivotable frame 134 shape are formed in a protruding manner from the inner side face of each of both the short frames of the handle 132.

The coupling rib 132*b* is a sort of protrusion having a predetermined length. The coupling rib 132*b* is inserted into the pivotable frame 134, and coupled to the pivotable frame 134.

The pivotable frame 134 has a bar shape having a predetermined thickness, and includes a pair of the pivotable frames 134. The pivotable frames 134 are respectively coupled to the inner side of the short frame of the handle 132 so as to face each other. Each of the pivotable frames 134 has a length larger than a length of the inner side of the short frame of the handle 132. More specifically, each of the pivotable frames 134 has a length such that a portion of the pivotable frame 134 may be exposed to the outside of an end of the handle 132.

A pivotable portion 134*a* which is inserted into the handle support 312 is provided at one end of the pivotable frame 134. A connecting hole 134*b* for inserting the connecting member 136 therein, a rib hole 134*c* for inserting the coupling rib 132*b* therein, and a hinge hole 134*d* for inserting the hinge 134*e* therein are defined to pass through a plate face, respectively.

As shown in FIG. 9, the pivotable portion 134*a* extends from the one end of the pivotable frame 134 in a substantially 'V' shape. The pivotable portion 134*a* has a shape in which both ends thereof are opened in the shape 'V' around a pivoting point "a". The pivotable portion 134*a* has one end thereof connected to the one end of the pivotable frame 134, and the other end thereof extending in an opposite direction (defined as a distal end "b") around the pivoting point "a". The other end of the pivotable portion 134*a* extended is a part inserted into the handle support 312 of the support bracket 310. The distal end "b" of the pivotable portion 134*a* may be disposed in line with the one end of the pivotable frame 134.

The pivotable portion 134*a* may temporarily fix the inner casing 100 to the outer casing 300 by being inserted into the handle support 312 of the support bracket 310. In addition, the pivotable portion 134*a* may separate the inner casing 100 from the outer casing 300 by being separated from the handle support 312.

In more detail, the pivotable portion 134*a* serves as a sort of lever. The pivotable portion 134*a* is pivoted about the pivoting point "a" so that the distal end "b" is inserted into/released from the through-hole defined in the handle support 312. When the pivotable portion 134*a* is inserted into the handle support 312, the handle 132 is temporarily fixed to the outer casing 300. Conversely, when the pivotable portion 134*a* is disengaged from the handle support 312, the handle 132 is separated from the outer casing 300.

As shown in FIG. 9, when the user picks up the inner casing 100 and inserts it into the outer casing 300, the end of the pivotable portion 134*a* is protruding toward the support bracket 310 of the outer casing 300. The pivotable portion 134*a* and the front frame 130 may interfere when the handle 132 is pivoted for use. In order to prevent this, the front frame 130 may be partially cut as described above. Alternatively, a hole corresponding to a pivot locus of the pivotable portion 134*a* may be defined in the front frame 130.

When the user inserts the inner casing 100 into the outer casing 300, and then pivots the handle 132 to its original position, the pivotable portion 134*a* is inserted into the handle support 312 of the support bracket 310. Since the pivotable portion 134*a* is formed in the 'V' shape at the end of the pivotable frame 134, the pivotable portion 134*a* may be inserted into the handle support 312 depending on the pivot of the handle 132.

In more detail, as the handle 132 pivots, the pivoting point "a" of the pivotable portion 134*a*, which was spaced apart from the support bracket 310, gradually approaches the support bracket 310. When the handle 132 is fully pivoted and returned to its original position, the pivoting point "a" is brought into contact with the plate surface of the support bracket 310. With respect to FIG. 10, the end of the pivotable portion 134*a* faces a left side of the pivoting point "a". The handle support 312 of the support bracket 310 is also located at the left side of the pivoting point "a" so that the pivotable portion 134*a* of the handle 132 may be naturally inserted into the handle support 312. Therefore, a convenience of the user is improved because the user does not have to check the position of the pivotable portion 134*a* when fixing the handle 132.

When the user pulls out the inner casing 100 from the outer casing 300, the pivotable frame 134 of the handle 132 acts as the lever. In order to use the handle 132, the user may pivot the handle 132 to the left with respect to FIG. 10. With reference to FIG. 10, as the handle 132 pivots, the distal end of the pivotable portion 134*a* is pivoted to the right about the pivoting point "a". As the handle 132 pivots, a pivoting point "a" serves as a center point of the lever, so that the distal end "b" of the pivotable portion 134*a* pushes the outer casing 300 to lift the inner casing 100 up. As the handle 132 pivots, the inner casing 100 is pushed up from the outer casing 300. Therefore, the user may separate the inner casing 100 from the outer casing 300 without great effort.

In a protective relay according to an embodiment of the present disclosure, the above-mentioned structure is summarized as follows when the inner casing is inserted and pulled out.

The protective relay 10 is provided by coupling the inner casing 100 with the outer casing 300.

When inserting the inner casing 100 into the outer casing 300, the user pivots the handle 132 to lift the inner casing 100. In this connection, the handle 132 is pivoted perpendicular to the front frame 130 (see FIG. 5 for the pivot state of the handle). The pivotable portion 134*a* of the handle 132 is projected toward the back casing 150. Although not shown in the drawing, the hole is defined to pass through the front frame 130 such that the back casing does not interfere the pivotable portion 134*a* when the pivotable portion 134*a* pivots. In this way, the pivotable portion 134*a* may pivot toward the back casing 150.

As shown in FIG. 5, while lifting the inner casing 100, the user inserts the inner casing 100 into the opened portion of the outer casing 300. After inserting the inner casing 100 into the outer casing 300, the user may pivot the handle 132 to its original position. As the handle 132 is pivoted, the pivoting point "a" of the pivotable portion 134*a* is brought into contact with the plate face of the support bracket 310 of the outer casing 300. When the handle 132 is continuously pivoted with the pivoting point "a" in contact with the plate face of the support bracket 310, the pivotable portion 134*a* is inserted into the through-hole of the handle support 312. The pivotable portion 134*a* of the handle 132 is inserted into the handle support 312 of the support bracket 310 so that the handle 132 is temporarily fixed to the outer casing 300.

In this state, the user may insert the bolt into the handle fixing part 132*a* of the handle 132 so that the handle 132 is fixed to the front frame 130. The handle 132 constitutes a part of the front frame 130, and is fixed to the outer casing 300, so that the inner casing 100 may be kept fixed to the outer casing 300.

Conversely, when separating the inner casing 100 from the outer casing 300, the user may open the handle cover 138, and separate the bolt to allow the handle 132 to be separated from the front frame 130. Thereafter, As shown in FIG. 5 and FIG. 10, the user may pivot the handle 132 perpendicular to the front frame 130.

As shown in FIG. 9, as the handle 132 pivots, the pivotable portion 134*a* is disengaged from the handle support 312, so that the handle 132 is separated from the support bracket 310 of the outer casing 300. The end "b" of the pivotable portion 134*a* extending around the pivoting point "a" may serve as the lever. That is, the distal end "b" of the pivotable portion 134*a* may push the inner casing 100 away from the support bracket 310 around the pivoting point "a".

The pivotable portion 134*a* pushes the inner casing 100 out of the outer casing 300 so that the user may separate the inner casing 100 from the outer casing with less force than when there is no lever structure.

According to the above-described structure, the user may separate the inner casing from the outer casing only by pivoting the handle without adjusting the position of the handle assembly. In addition, for the same reason, the inner casing may be easily mounted in the outer casing.

It will be apparent to those skilled in the art to which the present disclosure belongs that substitutions, modifications, and variations may be made without departing from the spirit and scope of the present disclosure. Thus, the above-mentioned present disclosure is not limited to the above-described embodiments and the accompanying drawings.

What is claimed is:

1. A protective relay comprising:

an inner casing including:

a back casing having a receiving space defined therein for accommodating a component therein;

a front casing having a display and a plurality of buttons, wherein the front casing is coupled to the back casing;

a front frame disposed along an edge of the inner casing;

a handle having a lever structure, wherein the handle is pivotably coupled to the front casing, defines a portion of the front frame, and has a 90 degrees-pivoted U shape, wherein both ends thereof are pivotably coupled to the front casing; and a pair of pivotable frames respectively coupled to an inner side of the handle so as to face each other; and an outer casing constructed for detachably receiving the inner casing therein, wherein the outer casing includes a pair of support brackets respectively mounted on both opposite sides of an open end of the outer casing for detachably supporting the handle, wherein each of the support brackets includes a handle support protruding toward the inner casing, wherein when the inner casing is separated from the outer casing, the handle pivots at a state where a portion thereof is in contact with the support brackets, thereby pushing the inner casing out of the outer casing, wherein each of the pivotable frames has a distal end having a V shaped portion, wherein the distal end is pivotably coupled to the handle support, wherein each of the pivotable frames has a pivoting point at the distal end, and wherein when the pivotable frames are pivoted around the pivoting point together with a pivoting of the handle, the distal end of the pivotable frames is inserted or separated into or from the support brackets.

2. The protective relay of claim 1, wherein each of the support brackets has a through-hole defined in the handle support in a longitudinal direction of the support brackets.

3. The protective relay of claim 2, wherein as the handle pivots such that the inner casing is separated from the outer casing, the distal end of the pivotable frames pivots around the pivoting point to push the inner casing out of the outer casing.

* * * * *